US009518802B2

(12) United States Patent
Wei

(10) Patent No.: US 9,518,802 B2
(45) Date of Patent: Dec. 13, 2016

(54) MULTI-LAUNCHER FIREARM

(71) Applicant: Yanwei Wei, Shandong (CN)

(72) Inventor: Yanwei Wei, Shandong (CN)

( * ) Notice: Subject to any disclaimer, the term of this patent is extended or adjusted under 35 U.S.C. 154(b) by 496 days.

(21) Appl. No.: 14/148,719

(22) Filed: Jan. 6, 2014

(65) Prior Publication Data

US 2016/0216066 A1 Jul. 28, 2016

(51) Int. Cl.
*F41F 3/04* (2006.01)
*F41F 1/08* (2006.01)

(52) U.S. Cl.
CPC .. *F41F 1/08* (2013.01); *F41F 3/04* (2013.01)

(58) Field of Classification Search
CPC ..... F41F 3/04; F41F 3/045; F41F 3/0455; F41F 3/065; F41A 23/42; B64D 7/08
USPC ..... 89/18.813, 1.41, 1.815, 1.8
See application file for complete search history.

(56) References Cited

U.S. PATENT DOCUMENTS 2,481,910 A * 9/1949 D Ardenne ..... F41F 3/045 89/1.807
3,106,132 A * 10/1963 Biermann ..... F41F 3/04 89/1.815
4,064,806 A * 12/1977 Apstein ..... F42C 17/04 102/210
4,134,327 A * 1/1979 Piesik ..... F41F 3/077 89/1.8
4,324,168 A * 4/1982 Sano ..... F41A 19/58 102/215
4,353,284 A * 10/1982 Billottet ..... F41A 23/34 180/236
4,359,926 A * 11/1982 Sano ..... F41A 19/58 102/215
4,895,061 A * 1/1990 Baricos ..... F41F 3/0455 89/1.814
5,020,411 A * 6/1991 Rowan ..... F02G 1/043 376/319
6,123,007 A * 9/2000 O'Dwyer ..... F41A 19/65 102/217
6,610,971 B1 * 8/2003 Crabtree ..... F41F 3/04 244/3.1
2004/0244628 A1 * 12/2004 O'Dwyer ..... F41A 19/58 102/480
2006/0021497 A1 * 2/2006 Paul ..... F42B 39/14 89/1.815
2006/0107828 A1 * 5/2006 Veitch ..... F41F 3/04 89/1.809
2006/0130695 A1 * 6/2006 O'Dwyer ..... F41A 19/65 102/438
2007/0084102 A1 * 4/2007 O'Dwyer ..... F41A 19/61 42/85

(Continued)

*Primary Examiner* — Samir Abdosh

(57) ABSTRACT

A multi-launcher firearm includes a firearm body comprising a plurality of ammunition launchers for storing different types of ammunitions having different ranges in the respective ammunition launchers, an input device connected to the firearm body for receiving a designation inputted by a user, and a controller mounted on the firearm body and respectively connected to each ammunition launcher for receiving the designation from the input device and then controlling the ammunition launcher correspondent to the designation to launch out the ammunition stored therein. The ammunition in each ammunition launcher comprises a plurality of rocket projectiles. All the rocket projectiles stored in the ammunition launcher share an identical diameter.

18 Claims, 5 Drawing Sheets

(56) References Cited

U.S. PATENT DOCUMENTS

2009/0109063 A1* 4/2009 Grimshaw ..... F41F 3/065
340/945

* cited by examiner

MULTI-LAUNCHER FIREARM

BACKGROUND OF THE PRESENT INVENTION

Field of Invention

The present invention relates to a multi-launcher firearm, and more particularly to a multi-launcher firearm which is capable of containing different ammunitions having different ranges in respective launchers and launching the ammunition.

Description of Related Arts

As one of the conventional crew served weapons, the machine gun has advantages of enough ammunition, quick response and long-lasting firepower, but the machine gun provides limited suppressive firepower against long-distance objects. The machine gun and the ammunition thereof have little space for further development.

Another conventional crew served weapon, the light mortar, is capable of supplying the crew with enough curved firepower support and owns great operation flexibility via various techniques, whereas the conventional light mortar is unable to rapidly and directly fire under the operation by three operators. Thus the conventional light mortar can hardly be an ideal crew weapon for squads and platoons. The mortar, no matter the light mortar or the assault mortar, has the great suppressive firepower, but the mortar is significantly defected at velocity, direct launching and mobile firing.

Despite of the great development prospect, the automatic grenade launcher is too expensive as one infantry weapon having the giant equipment load and is destined to be unfit for arming the crew because of the weight and the ammunition portability.

Thus it is necessary to provide a multi-launcher firearm which is light in weight and has accessible ammunition and flexible launching manners by containing different ammunitions in respective launchers and launching the ammunition.

SUMMARY OF THE PRESENT INVENTION

An object of the present invention is to overcome above disadvantages and provide a multi-launcher firearm which contains different types of ammunitions having different ranges and allows users to select the ammunition for firing.

Another object of the present invention is to provide a multi-launcher firearm which is light in weight, in such a manner that the multi-launcher firearm is portable and needs only one operator.

Another object of the present invention is to provide a multi-launcher firearm which reduces a recoil force upon a user of the multi-launcher firearm and thus increases a shooting precision.

Yet another object of the present invention is to provide a multi-launcher firearm whose ammunition is accessible to the operator.

Accordingly, in order to accomplish the above objects, the present invention provides a multi-launcher firearm which comprises a firearm body comprising a plurality of ammunition launchers for storing different types of ammunitions having different ranges in the respective ammunition launchers, an input device connected to the firearm body for receiving a designation inputted by a user, and a controller mounted on the firearm body and respectively connected to each ammunition launcher for receiving the designation from the input device and then controlling the ammunition launcher correspondent to the designation to launch out the ammunition stored therein.

Preferably, the ammunition in each ammunition launcher comprises a plurality of rocket projectiles. The rocket projectile has a lower speed than a grenade at an initial launching phase, in such a manner that the rocket projectile exerts a smaller recoil force on the user and has a higher shooting precision than the grenade.

Further preferably, the rocket projectile has a cartridge for protecting each rocket projectile from a fire generated in a launching process of the previous rocket projectile.

These and other objectives, features, and advantages of the present invention will become apparent from the following detailed description, the accompanying drawings, and the appended claims.

DETAILED DESCRIPTION OF THE PREFERRED EMBODIMENT

Figure 1:
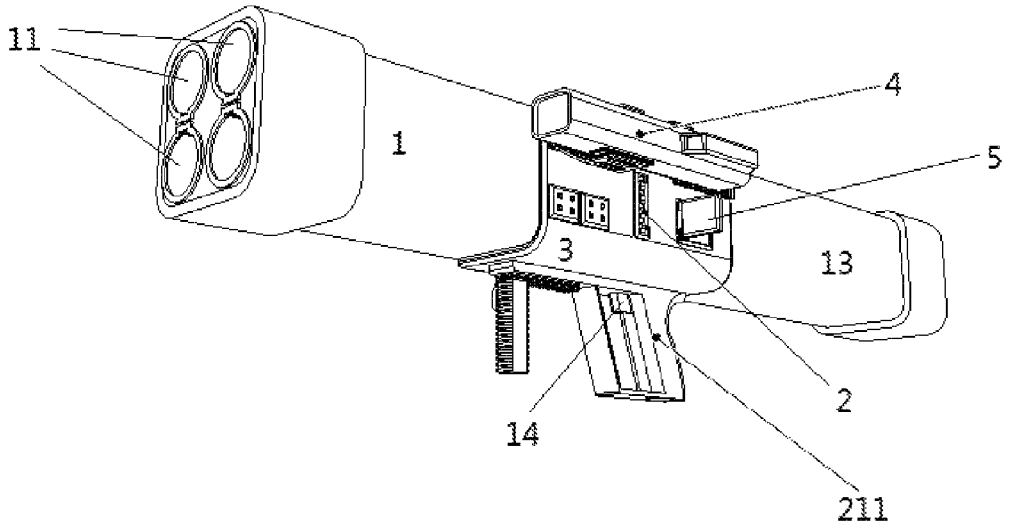
FIG. 1 is a perspective view of a multi-launcher firearm according to a first preferred embodiment of the present invention.
Figure 2:
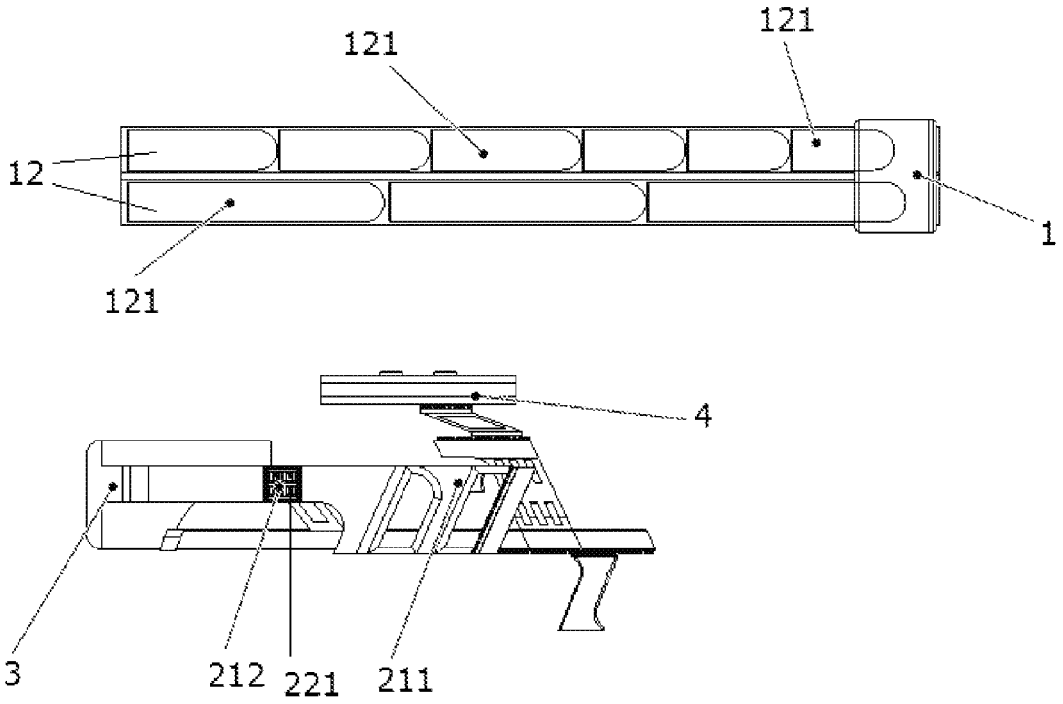
FIG. 2 is an exploded view of the multi-launcher firearm according to the first preferred embodiment of the present invention.

Referring to FIGS. 1 and 2 of the drawings, according to a first preferred embodiment of the present invention, a multi-launcher firearm comprises a firearm body 1 comprising a plurality of ammunition launchers 11 for storing different types of ammunitions 12 having different ranges in the respective ammunition launchers 11, an input device 2 connected to the firearm body 1 for receiving a designation inputted by a user, and a controller 3 mounted on the firearm body 1 and respectively connected to each ammunition launcher 11 for receiving the designation from the input device 2 and then controlling the ammunition launcher 11 correspondent to the designation to launch out the ammunition 12 stored therein.

The ammunition 12 comprises a rocket projectile 121; the controller 3 further comprises an igniting device 31 connected to the rocket projectile 121 and the input device 2, for igniting the rocket projectile 121 according to the designation sent from the input device.

Figure 3:
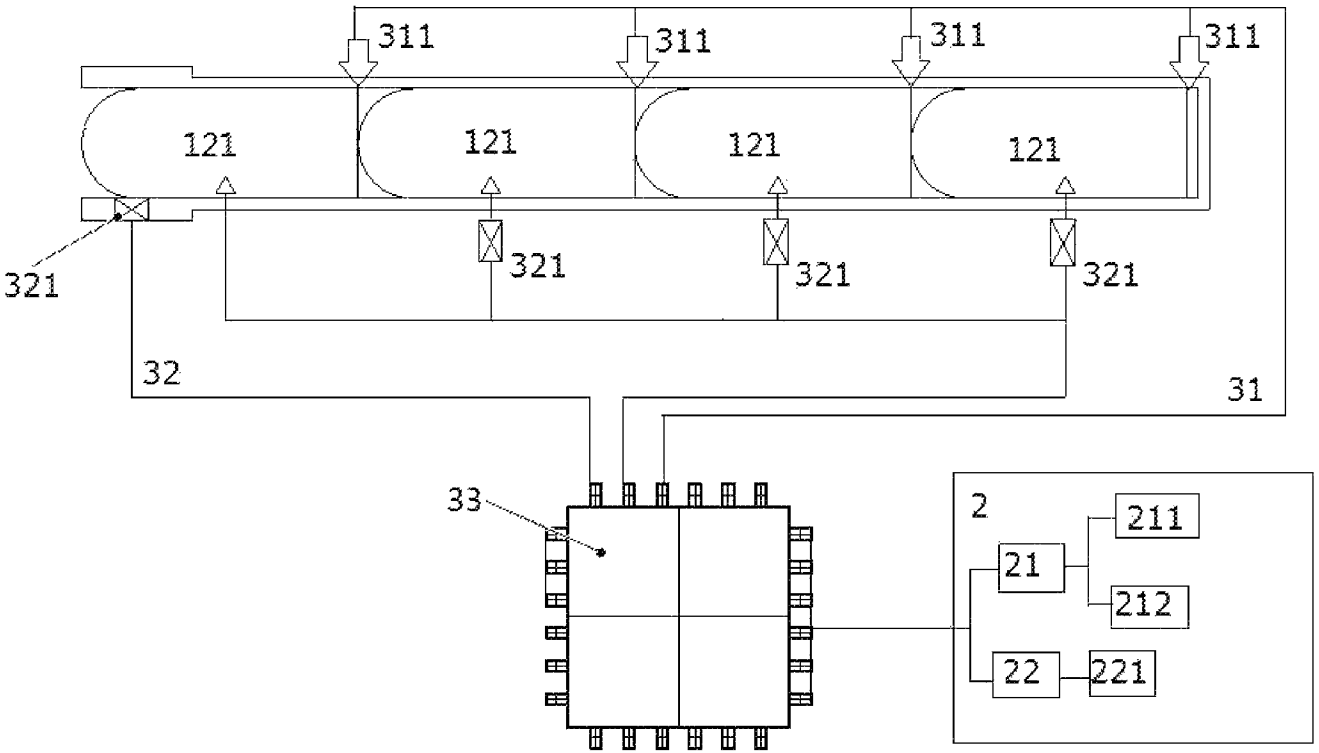
FIG. 3 is a sketch view of a controller and an input device of the multi-launcher firearm according to the first preferred embodiment of the present invention.
Figure 4:
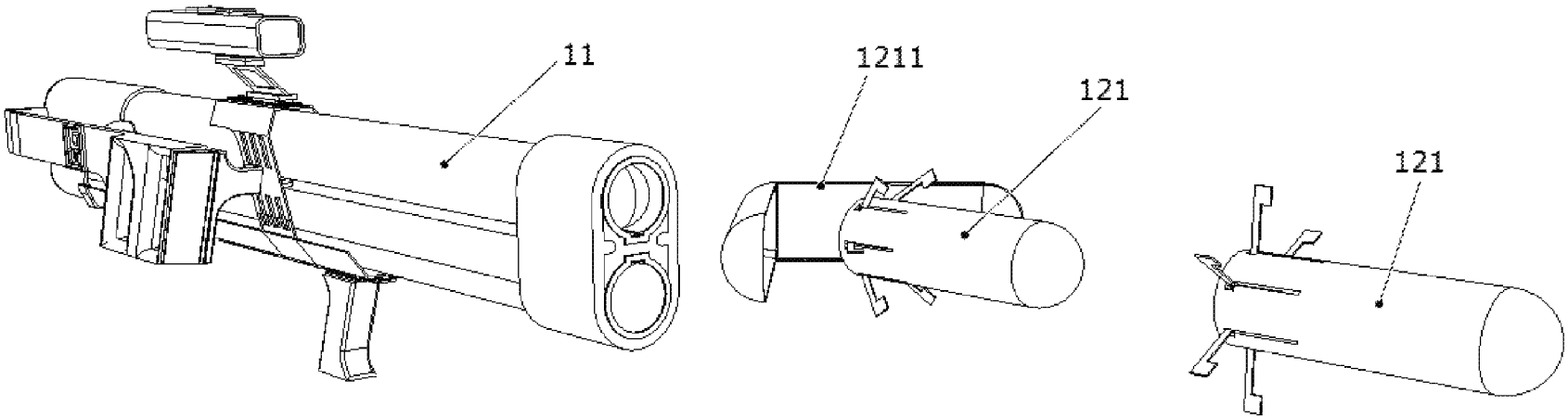
FIG. 4 is a sketch view of a process of a cartridge which gradually peels off from a rocket projectile according to the first preferred embodiment of the present invention.

Further, the ammunition 12 comprises a plurality of rocket projectiles 121 which are connected head to tail to form a chain; as showed in FIG. 3, the igniting device 31 comprises a plurality of igniters 311 respectively connected to the rocket projectiles 121, for respectively igniting the rocket projectiles 121 in turn under a control of the controller 3, so as to greatly reduce a weight of the multi-launcher firearm and relief the user from a strong recoiling force; as showed in FIG. 4, the rocket projectile 121 has a cartridge 1211 for protecting each rocket projectile 121 from a fire generated in the launching process of the former rocket projectile 121, in such a manner that each rocket projectile 121 is respectively and independently launched without mutual interference. The controller 3 further comprises a sensing device 32 connected to each rocket projectile 121 for sensing a launching process of each rocket projectile 121, so as to facilitate controlling the rocket projectiles 121 to be launched out in turn by the controller 3.

Further, as showed in FIG. 3, the sensing device 32 comprises a plurality of pressure sensors 321 provided under each rocket projectile 121, for sensing a pressure generated by the launching process of each rocket projectile 121 and accordingly sending out a pressure signal; the controller 3 further comprises a processor 33 for storing the designation sent from the input device 2, and the pressure signal sent from each pressure sensor 321, counting a total number of received pressure signals as n, and controlling an (n+1)th igniter 311 to ignite an (n+1)th rocket projectile 121, wherein n is an integer no smaller than 0 and n+1 is no larger than a maximum number of the rocket projectiles 121 stored in the ammunition launcher 11.

Preferably, as showed in FIG. 2, all the rocket projectiles 121 stored in the ammunition launcher 11 share an identical diameter, but have different lengths, in such a manner that the ammunition launcher 11 is able to contain more than one type of ammunition 12, so as to improve ammunition accessibility for the user.

Preferably, as showed in FIG. 4, after protecting the rocket projectile 121 from the fire, the cartridge 1211 passively or automatically peels off the rocket projectile 121 when the rocket projectile 121 leaves an opening of the ammunition launcher 11.

Further, as showed in FIGS. 1, 2 and 3, the input device 2 comprises a launcher 21 for launching the rocket projectile 121 out of the ammunition launcher 11, and a shifter 22 for shifting among the different ammunition launchers 11 and changing the ammunition launcher 11 which is connected to the igniting device 31. When the launcher 21 is activated, the launcher 21 sends a launching signal into the processor 33 of the controller 3; the controller 3 stores the launching signal sent from the launcher 21, reads the total number of the received pressure signals n, and controls the (n+1)th igniter 311 to ignite the (n+1)th rocket projectile 121 according to the (n+1)th received launching signal. When the shifter 22 is activated, the shifter 22 sends a shifting signal into the processor 33; the processor 33 receives the shifting signal, cuts the connection between the ammunition launcher 11 and the processor 33 and establishes the connection between another ammunition launcher 11 and the processor 33. A connection shifting order can be designated.

Preferably, as showed in FIGS. 2 and 3, the launcher 21 comprises a trigger 211 provided below the firearm body 1, wherein the rocket projectile 121 is launched by pulling the trigger 211; the shifter 22 comprises a first shifter button 221 mounted on the right side of the firearm body 1, wherein the ammunition launchers 11 are shifted by pressing down the first shifter button 221.

Preferably, as showed in FIGS. 2 and 3, the launcher 21 further comprises a first launching button 212 mounted to the right side of the firearm body 1 and beside the first shifter button 221, for launching the rocket projectile 121 out of the ammunition launcher 11. When the first launching button 212 is pressed down, the first launching button 212 sends a launching signal to the processor 33; the processor 33 stores the launching signal sent from the first launching button 212, and controls the (n+1)th igniter 311 to ignite the (n+1)th rocket projectile 121 based on the total number of the received pressure signals n after receiving the (n+1)th launching signal.

Further, as showed in FIG. 1, the multi-launcher firearm further comprises a sight device 4 mounted to the right side of the firearm body 1 and above the input device 2 for observing and aiming at a target, and a display screen 5 mounted to the right side of the firearm body 1 and beside the input device 2 for displaying which ammunition launcher 11 is currently connected to the igniting device 31 and for displaying information about the target, such as a distance between the target and the opening of the multi-launcher firearm. Preferably, in order to save space, the sight device 4 and the display screen 5 are both stretchable and rotatable.

Figure 5:
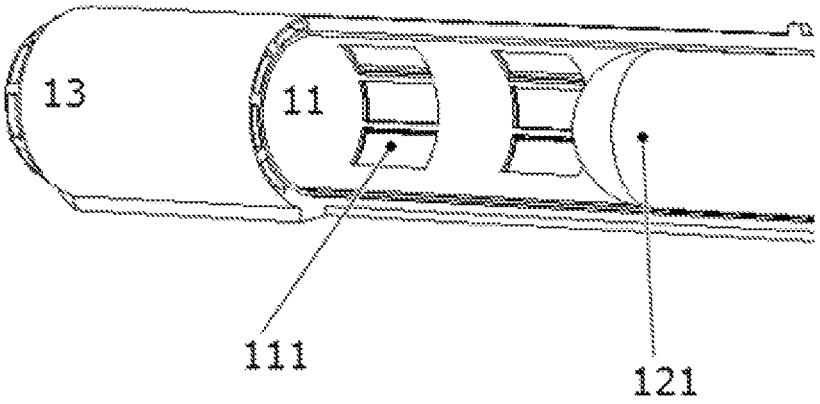
FIG. 5 is a sketch view of an ammunition launcher and an ammunition barrel of the multi-launcher firearm according to the first preferred embodiment of the present invention.

Referring to FIG. 1 of the drawings, according to the first preferred embodiment of the present invention, the firearm body 1 of the multi-launcher firearm further comprises an ammunition barrel 13 for mounting the plurality of ammunition launcher 11 together within the ammunition barrel 13, wherein each ammunition launcher 11 is parallel with each other and with the ammunition barrel 13. Referring to FIG. 5, according to the preferred embodiment of the present invention, each ammunition launcher 11 has a plurality of holes 111 spaced at a certain interval for discharging an air flow generated by the launching process of each rocket projectile 121; space is provided between an outer wall of each ammunition launcher 11 and an inner wall of the ammunition barrel 13, in such a manner that the space between an end of the outer wall of each ammunition launcher 11 and an end of the inner wall of the ammunition barrel 13 forms an exit for the air flow to leave the firearm body 1, so as to further reduce the recoil force brought by the launching process of the rocket projectiles 121.

As showed in FIG. 1, the ammunition launcher 11 of the multi-launcher firearm further comprises a fixing bolt 14 provided below each ammunition launcher 11 and below the controller 3, for mounting each ammunition launcher 11 and the controller 3 together.

Figure 6:
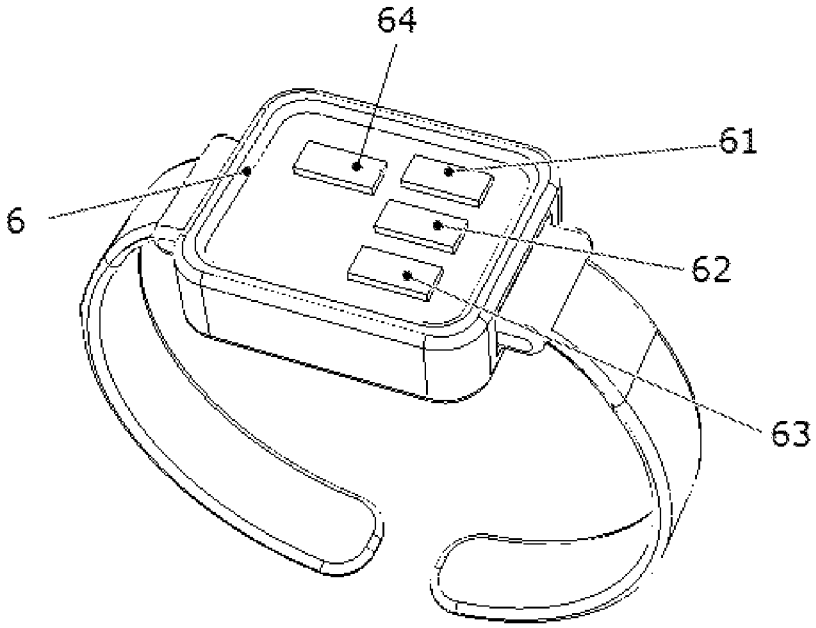
FIG. 6 is a perspective view of a wireless input device of the multi-launcher firearm according to a second preferred embodiment of the present invention.

According to a second preferred embodiment of the present invention, as showed in FIG. 6, the multi-launcher firearm further comprises a wireless input device 6 which is wirelessly connected to the processor 33 of the controller 3 for sending the designation of the user at a certain distance. The wireless input device 6 has a second launching button 61 for launching the rocket projectile 121 out of the ammunition launcher 11, and a second shifter button 62 for shifting among the different ammunition launchers 11 and changing the ammunition launcher 11 which is connected to the igniting device 31. When the second launching button 61 of the wireless input device 6 is pressed down, the wireless input device 6 generates a launching signal and sends the launching signal into the processor 33; the processor 33 stores the launching signal sent from the wireless input device 6, reads the total number of the received pressure signal n, and controls the (n+1)th igniter 311 to ignite the (n+1)th rocket projectile 121 according to the (n+1)th received launching signal. When the second shifter button 62 of the wireless input device 6 is pressed down, the wireless input device 6 generates a shifting signal and sends the shifting signal into the processor 33; the processor 33 stores the shifting signal sent from the wireless input device 6, cuts down the connection to the ammunition launcher 11 and establishes the connection to another ammunition launcher 11.

Preferably, as showed in FIG. 6, the wireless input device 6 further has a locking button 63 for locking up the input device 64, in such a manner that the input device 2 connected to the firearm body 1 is unable to function, and an unlocking button 64 for unlocking the locked input device 2, in such a manner that the input device 2 recover to be able to function.

When the locking button 63 is pressed down, the locking button 63 sends out a disconnecting signal into the processor 33; the processor 33 receives the disconnecting signal and accordingly cuts down the connection to the input device 2, in such a manner that the processor 33 are unable to receive any signal sent from the input device 2 provided on the firearm body 1 and then the user is only able to fire with the multi-launcher firearm via the wireless input device 6. When the unlocking button 64 is pressed down, the unlocking button 64 sends out a connecting signal into the processor 33; the processor 33 receives the connecting signal, and recovers the connection to the input device 2, in such a manner that the processor 33 are able to normally receive the signal sent from the input device 2 again and then the user is able to fire with the multi-launcher firearm via the wireless input device 6 and the input device 2 connected to the firearm body 1.

As showed in FIG. 6, the wireless input device 6 is watch-shaped and thus wearable on a wrist. The second launching button 61, the second shifter button 62, the locking button 63 and the unlocking button 64 are all mounted on a surface of the watch-shaped wireless input device 6. The wireless input device 6 accomplishes a remote control of the multi-launcher firearm; even if the multi-launcher firearm is far away from the user, the user is still able to disenable the multi-launcher firearm via the wireless input device 6 and also able to control the launching process of the rocket projectiles 121, so that the multi-launcher firearm well accommodates various needs in practical battlefields.

Figure 7:
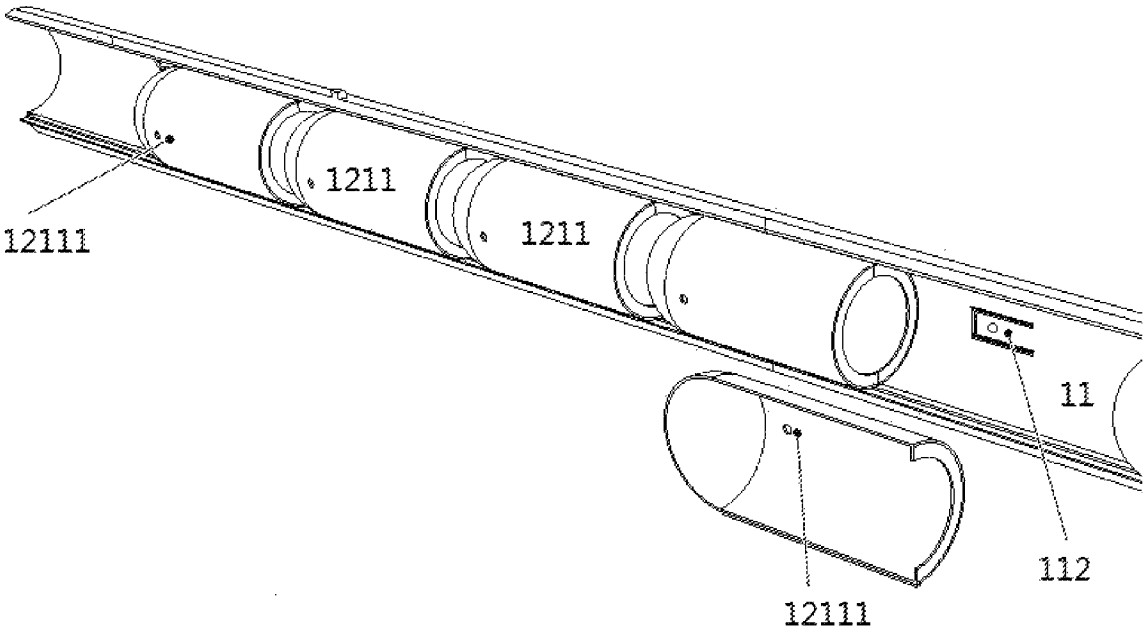
FIG. 7 is a sketch view of a convex fixer of the ammunition launcher and a correspondent hole of the rocket projectile of the multi-launcher firearm according to a third preferred embodiment of the present invention.

According to a third preferred embodiment of the present invention, based on the second preferred embodiment, as showed in FIG. 7, each ammunition launcher 11 further has a plurality of convex fixers 112 provided at an inner wall thereof for fixing each rocket projectile 121 in a correspondent position; the cartridge 1211 of each rocket projectile 121 has a hole 12111 whose shape matches with the correspondent fixer 112. The convex fixer 112 is elastic; when the rocket projectile 121 is loaded into the ammunition launcher 11 through the opening, the convex fixer 112 firstly is squeezed outwardly into the inner wall of the ammunition launcher 11; when the rocket projectile 121 is pushed in further, the convex fixer 112 exactly meets the hole 12111 on the cartridge 1211, when the convex fixer 112 is released out to fill the hole 12111, in such a manner that the rocket projectile 121 is fixed currently; by continuing pushing the rocket projectile 121 into the ammunition launcher 11, the convex fixer 112 is pushed outwardly and retracted into the inner wall again. The rocket projectile 121 is pushed in continually until arriving at the correspondent position.

One skilled in the art will understand that the embodiment of the present invention as shown in the drawings and described above is exemplary only and not intended to be limiting. A number of the ammunition launchers can be two, three, four and even more.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A multi-launcher firearm, comprising:

different types of rocket projectiles having different ranges;

a firearm body comprising a plurality of ammunition launchers for storing said different types of rocket projectiles in said respective ammunition launchers;

an input device connected to said firearm body for receiving a designation inputted by a user; and a controller mounted on said firearm body and respectively connected to each said ammunition launcher for receiving the designation from said input device and then controlling said ammunition launcher correspondent to the designation to launch out said ammunition stored therein;

wherein said ammunition comprises a rocket projectile; said controller comprises an igniting device connected to said rocket projectile, for igniting said rocket projectile under the designation of the user, so as to reduce a total weight and reduce a recoil force brought by launching said ammunition;

wherein said ammunition further comprises a plurality of rocket projectiles which are connected head to tail to form a chain; said igniting device comprises a plurality of igniters respectively connected to said rocket projectiles, for respectively igniting said rocket projectile; and said controller further comprises a sensing device connected to each said rocket projectile, for sensing a launching process of each said rocket projectile, so as to facilitate controlling each said rocket projectiles to be launched out in turn by said controller.

2. The multi-launcher firearm, as recited in claim 1, wherein each said rocket projectile has a cartridge for protecting each said rocket projectile from a fire generated by said launching process of said former rocket projectile, in such a manner that said plurality of rocket projectiles is respectively and independently launched without mutual interference.

3. The multi-launcher firearm, as recited in claim 2, wherein said sensing device comprises a plurality of pressure sensors provided under each said rocket projectile, for sensing a pressure generated by said launching process of each said rocket projectile and accordingly sending out a pressure signal; said controller further comprises a processor for storing the designation sent from said input device, and the pressure signal sent from each said pressure sensor, counting a total number of received pressure signals as n, and controlling an (n+1)th igniter to ignite an (n+1)th rocket projectile, wherein n is an integer no smaller than 0 and n+1 is no larger than a maximum number of said rocket projectiles stored in said ammunition launcher.

4. The multi-launcher firearm, as recited in claim 3, wherein said input device comprises a launcher for launching said rocket projectiles out of said ammunition launcher, and a shifter for shifting among said different ammunition launchers and changing said ammunition launcher which is connected to said igniting device; wherein after being activated, said launcher sends a launching signal into said processor of said controller; said controller stores the launching signal sent from said launcher, reads the total number of the received pressure signals n, and controls said (n+1)th igniter to ignite said (n+1)th rocket projectile according to the (n+1)th received launching signal; and after being activated, said shifter sends a shifting signal into said processor; said processor receives the shifting signal, cuts a connection between said ammunition launcher and said processor and establishes a connection between another ammunition launcher and said processor.

5. The multi-launcher firearm, as recited in claim 4, wherein said launcher comprises a trigger provided below said firearm body, in such a manner that said rocket projectile is launched by pulling said trigger; said shifter comprises a first shifter button mounted on said right side of said firearm body, in such a manner that said ammunition launchers are shifted by pressing down said first shifter button; and said launcher further comprises a first launching button mounted to said right side of said firearm body and beside said first shifter button, for launching said rocket projectile out of said ammunition launcher.

6. The multi-launcher firearm, as recited in claim 5, further comprising a wireless input device which is wirelessly connected to said processor, for sending the designation of the user at a certain distance; wherein said wireless input device has a second launching button for launching said rocket projectile out of said ammunition launcher, and a second shifter button for shifting among said different ammunition launchers and changing said ammunition launcher which is connected to said igniting device; wherein when said second launching button is pressed down, said wireless input device generates a launching signal and sends the launching signal into said processor; said processor stores the launching signal sent from said wireless input device, reads the total number of the received pressure signal n, and controls said (n+1)th igniter to ignite said (n+1)th rocket projectile according to the (n+1)th received launching signal; and when said second shifter button is pressed down, said wireless input device generates a shifting signal and sends the shifting signal into said processor; said processor stores the shifting signal sent from said wireless input device, cuts down a connection to said ammunition launcher and establishes a connection to another ammunition launcher.

7. The multi-launcher firearm, as recited in claim 6, wherein said wireless input device further has a locking button for locking up said input device, in such a manner that said input device connected to said firearm body is unable to function, and an unlocking button for unlocking said locked input device, in such a manner that said input device recover to be able to function.

8. The multi-launcher firearm, as recited in claim 7, wherein when said second launching button is pressed down, said wireless input device generates a launching signal and sends the launching signal into said processor; said processor stores the launching signal sent from said wireless input device, reads the total number of the received pressure signal n, and controls said (n+1)th igniter to ignite said (n+1)th rocket projectile according to the (n+1)th received launching signal; and wherein when said second shifter button is pressed down, said wireless input device generates a shifting signal and sends the shifting signal into said processor; said processor stores the shifting signal sent from said wireless input device, cuts down a connection to said ammunition launcher and establishes a connection to another ammunition launcher.

9. The multi-launcher firearm, as recited in claim 8, further comprising a sight device mounted to said right side of said firearm body and above said input device for observing and aiming at a target, and a display screen mounted to said right side of said firearm body and beside said input device for displaying which ammunition launcher is currently connected to said igniting device and for displaying information about the target, such as a distance between the target and an opening of the multi-launcher firearm.

10. The multi-launcher firearm, as recited in claim 2, wherein all said rocket projectiles stored in said ammunition launcher share an identical diameter, but have different lengths, in such a manner that said ammunition launcher is able to contain more than one type of ammunition having different ranges, so as to improve ammunition accessibility and provide multiple options for the user.

11. The multi-launcher firearm, as recited in claim 2, wherein each ammunition launcher has a plurality of convex fixers provided at an inner wall thereof for fixing each rocket projectile at a correspondent position; said cartridge of each rocket projectile has a hole whose shape matches with said correspondent fixer; wherein each said convex fixer is elastic, in such a manner that said convex fixer is squeezed outwardly into said inner wall of said ammunition launcher, when said rocket projectile is loaded into said ammunition launcher through an opening, and then said convex fixer is released out to fill said hole and to fix the rocket projectile securely, when said rocket projectile is pushed in further and said convex fixer exactly meets said hole.

12. The multi-launcher firearm, as recited in claim 9, wherein each ammunition launcher has a plurality of convex fixers provided at an inner wall thereof for fixing each rocket projectile at a correspondent position; said cartridge of each rocket projectile has a hole whose shape matches with said correspondent fixer; wherein each said convex fixer is elastic, in such a manner that said convex fixer is squeezed outwardly into said inner wall of said ammunition launcher, when said rocket projectile is loaded into said ammunition launcher through an opening, and then said convex fixer is released out to fill said hole and to fix the rocket projectile securely, when said rocket projectile is pushed in further and said convex fixer exactly meets said hole.

13. The multi-launcher firearm, as recited in claim 2, wherein said cartridge passively or automatically peels off from said rocket projectile when said rocket projectile is launched out of said ammunition launcher through an opening of said ammunition launcher.

14. The multi-launcher firearm, as recited in claim 12, wherein said cartridge passively or automatically peels off from said rocket projectile when said rocket projectile is launched out of said ammunition launcher through said opening of said ammunition launcher.

15. The multi-launcher firearm, as recited in claim 1, wherein said firearm body further comprises an ammunition barrel for mounting said plurality of ammunition launchers together within said ammunition barrel, wherein each said ammunition launcher is parallel with each other and with said ammunition barrel.

16. The multi-launcher firearm, as recited in claim 14 wherein said firearm body further comprises an ammunition barrel for mounting said plurality of ammunition launchers together within said ammunition barrel, wherein each said ammunition launcher is parallel with each other and with said ammunition barrel.

17. The multi-launcher firearm, as recited in claim 1, wherein each said ammunition launcher has a plurality of holes spaced at a certain interval for discharging an air flow generated by a launching process of said rocket projectile; space is provided between an outer wall of each said ammunition launcher and an inner wall of said ammunition barrel, in such a manner that said space between an end of said outer wall of each said ammunition launcher and an end of said inner wall of said ammunition barrel forms an exit for the air flow to leave said firearm body, so as to further reduce the recoil force brought by a launching process of said rocket projectile.

18. The multi-launcher firearm, as recited in claim 16, wherein each said ammunition launcher has a plurality of holes spaced at a certain interval for discharging an air flow generated by a launching process of each rocket projectile; space is provided between an outer wall of each said ammunition launcher and an inner wall of said ammunition barrel, in such a manner that said space between an end of said outer wall of each said ammunition launcher and an end of said inner wall of said ammunition barrel forms an exit for the air flow to leave said firearm body, so as to further reduce the recoil force brought by said launching process of said rocket projectiles.

* * * * *